US009607538B2

(12) United States Patent
Cha et al.

(10) Patent No.: US 9,607,538 B2
(45) Date of Patent: Mar. 28, 2017

(54) METHOD FOR MANAGING POWER IN ELECTRONIC DEVICE AND THE ELECTRONIC DEVICE

(71) Applicant: INDUSTRY-ACADEMIC COOPERATION FOUNDATION, YONSEI UNIVERSITY, Seoul (KR)

(72) Inventors: Ho Jung Cha, Seoul (KR); Dong Won Kim, Seoul (KR); No Hyun Jung, Seoul (KR)

(73) Assignee: Industry-Academic Cooperation Foundation, Yonsei University, Seoul (KR)

( * ) Notice: Subject to any disclaimer, the term of this patent is extended or adjusted under 35 U.S.C. 154(b) by 12 days.

(21) Appl. No.: 14/644,090

(22) Filed: Mar. 10, 2015

(65) Prior Publication Data

US 2015/0262525 A1 Sep. 17, 2015

(30) Foreign Application Priority Data

Mar. 11, 2014 (KR) ..... 10-2014-0028558
Oct. 7, 2014 (KR) ..... 10-2014-0134829

(51) Int. Cl.
*G09G 3/32* (2016.01)
*G09G 3/20* (2006.01)

(52) U.S. Cl.
CPC ..... *G09G 3/20* (2013.01); *G09G 2320/103* (2013.01); *G09G 2340/0435* (2013.01)

(58) Field of Classification Search
CPC ..... G09G 3/20; G09G 2340/0435; G09G 2320/103; G09G 5/37; G09G 2320/0266
See application file for complete search history.

(56) References Cited

U.S. PATENT DOCUMENTS 8,179,388 B2 * 5/2012 Wyatt ..... G09G 5/18 345/204
8,334,857 B1 * 12/2012 Ogrinc ..... G09G 5/377 345/204
8,947,419 B2 * 2/2015 Yanagi ..... G09G 5/18 345/213
9,336,754 B2 * 5/2016 Li ..... G09G 3/20
2015/0109286 A1 * 4/2015 Verbeure ..... G09G 3/3406 345/419

FOREIGN PATENT DOCUMENTS

JP 2008 527418 A 7/2008
JP 2010-134455 6/2010
KR 10-2002-0072504 A 9/2002
KR 10-2002-0095237 A 12/2002
KR 1020060018393 A 3/2006
KR 10-2007-0030835 A 3/2007
KR 10-2007-0110113 A 11/2007
KR 10-2010-0056397 A 5/2010

* cited by examiner

*Primary Examiner* — Abbas Abdulselam
(74) *Attorney, Agent, or Firm* — TechLaw LLP

(57) ABSTRACT

The present invention relates to an electronic device and a method for managing power in the electronic device that can control the refresh rate to reduce power consumption. An embodiment of the invention provides a method for managing power in an electronic device that includes: measuring a content rate of a displayed content; and controlling a refresh rate based on the content rate.

3 Claims, 10 Drawing Sheets

METHOD FOR MANAGING POWER IN ELECTRONIC DEVICE AND THE ELECTRONIC DEVICE

CROSS-REFERENCE TO RELATED APPLICATIONS

This application claims the benefit of Korean Patent Application No. 10-2014-0028558, filed with the Korean Intellectual Property Office on Mar. 11, 2014, and Korean Patent Application No. 10-2014-0134829, filed with the Korean Intellectual Property Office on Oct. 7, 2014. The disclosures of the above patent applications are incorporated herein by reference in their entirety.

BACKGROUND

1. Technical Field

The present invention relates to a method for managing power in an electronic device and to an electronic device, more particularly to an electronic device that displays contents and a method for managing power in the electronic device.

2. Description of the Related Art

In mobile devices currently in the market, the refresh rate is fixed to 60 Hz, so that there may often be occurrences of unnecessary power consumption. Various approaches have been conceived for reducing power consumption in mobile devices. Previous research has attempted to reduce power by adjusting the clock of the display. One such attempt at reducing power involved applying a dynamic voltage frequency scaling (DVFS) policy to the clock of an OLED display, and one attempt involved adjusting the clock in only a portion of an OLED display. An example of a related document found in prior art is Korean Patent Publication No. 1999-012928.

In recent times, there has been research aimed at reducing power by adjusting the frame rate for a screen scroll in a mobile device. Such research did not adjust the refresh rate directly. Most importantly, previous research was not directed towards the power consumption that occurs redundantly and does not consider the content being displayed, so that the quality of the display is inevitably lowered.

Thus, there is a need for research on a method of managing power according to the characteristics of the content.

SUMMARY

One aspect of the invention provides an electronic device that displays contents and a method for managing power in the electronic device.

Also, an aspect of the invention provides an electronic device and a method for managing power in the electronic device that can reduce power consumption according to the content display and can provide an image that is comfortable for the user.

To achieve the objectives above, an embodiment of the invention provides a method for managing power in an electronic device that includes: measuring a content rate of a displayed content; and controlling a refresh rate based on the content rate.

To achieve the objectives above, an embodiment of the invention provides a method for managing power in an electronic device that includes: measuring a content rate by using a result on whether or not a change occurred between a current frame and a previous frame; and controlling a refresh rate based on the content rate.

To achieve the objectives above, an embodiment of the invention provides an electronic device that includes: a display part configured to display a content; a content rate measurement part configured to measure a content rate of the displayed content; a refresh rate control part configured to control a refresh rate based on the content rate; and a processor configured to control the display part, the content rate measurement part, and the refresh rate control part.

With the electronic device and the power management method for the electronic device according to an embodiment of the invention, the refresh rate may be controlled according to the content rate, so that the amount of power consumption can be reduced without lowering the picture quality of the content being displayed.

Additional aspects and advantages of the present invention will be set forth in part in the description which follows, and in part will be obvious from the description, or may be learned by practice of the invention.

DETAILED DESCRIPTION

The method of managing power in an electronic device and the electronic device associated with an embodiment of the invention will be described below in more detail with reference to the accompanying drawings.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

In the present specification, a frame rate refers to the frequency of updating frame data in the memory. The unit used can be FPS (frame per second). Also, a frame that has no change compared to the previous frame will be referred to as a redundant frame, and the number of redundant frames per unit time will be referred to as the redundant frame rate. Also, a frame that does have a change compared to the previous frame will be referred to as a meaningful frame.

In the present specification, a refresh rate refers to the frequency of change in the frame outputted on the screen. The unit used can be Hz.

Also, in the present specification, a content rate refers to the frequency of change in a content per unit time.

Figure 1A:
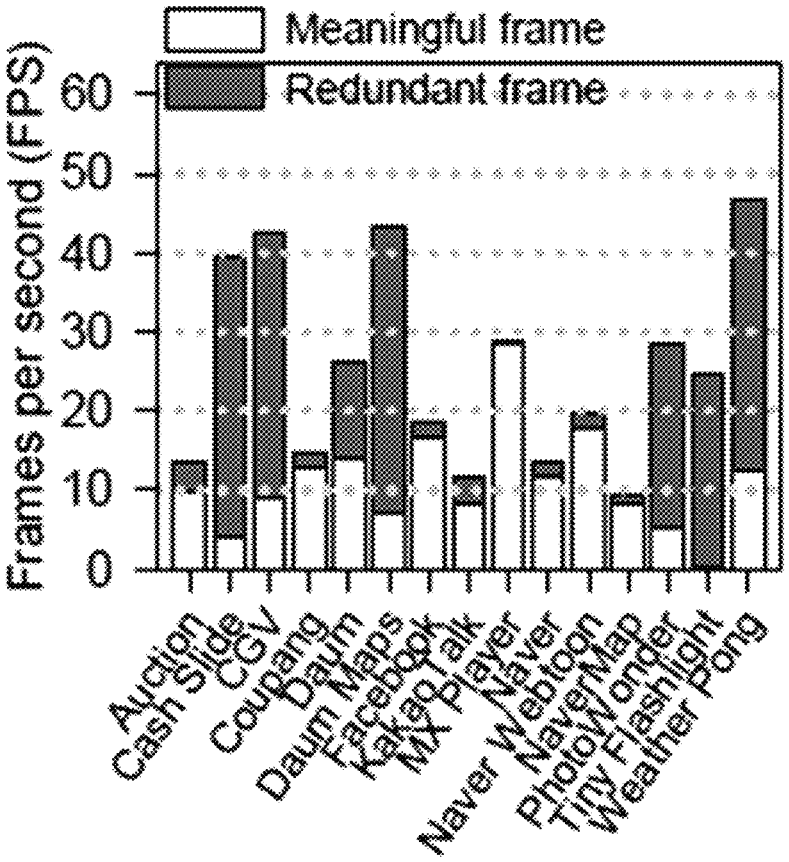
FIG. 1A and FIG. 1B show graphs of the redundant frame rates of several applications that may be displayed on an electronic device associated with an embodiment of the invention.
Figure 1B:
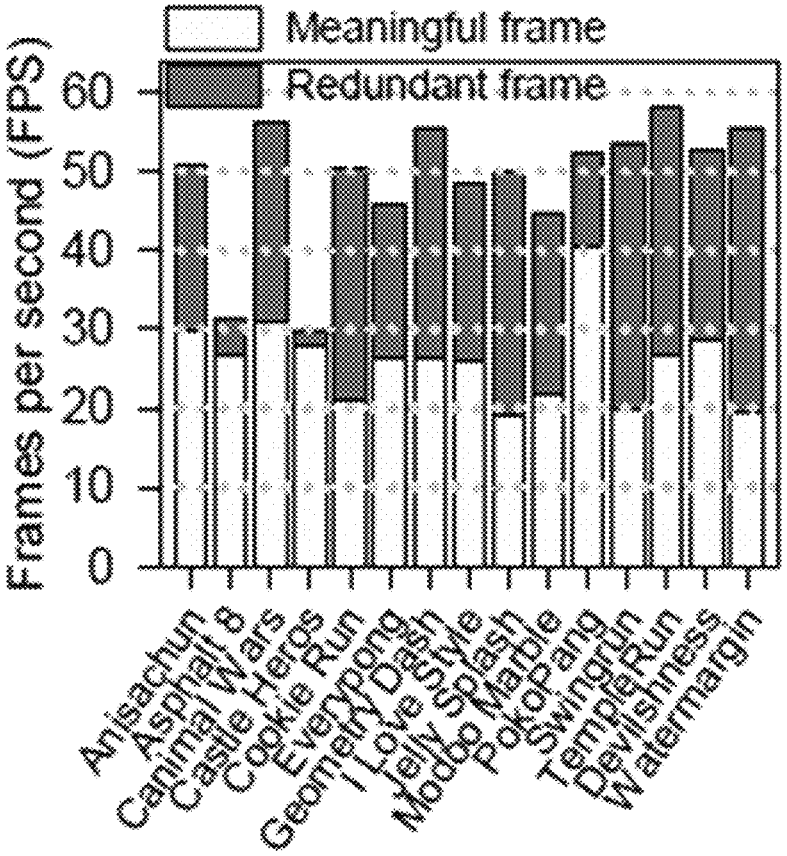

FIG. 1A and FIG. 1B show graphs of the redundant frame rates of several applications that may be displayed on an electronic device associated with an embodiment of the invention.

FIG. 1A illustrates meaningful frames and redundant frames in regular applications currently available in the market (other than game applications), while FIG. 1B illustrates meaningful frames and redundant frames in game applications currently available in the market.

As shown in the graphs, the frame rates of some of the regular applications and most of the game applications include redundant frame rates. In cases where the refresh rate is fixed (e.g. fixed to 60 Hz), redundant frames may be outputted on the screen with the same frequency as meaningful frames, thereby causing power consumption. Thus, there is a need for a method of adjusting the refresh rate in consideration of only meaningful frames.

An electronic device and a method of power management in an electronic device according to an embodiment of the invention can display application contents by considering the frame rates of meaningful frames.

Figure 2:
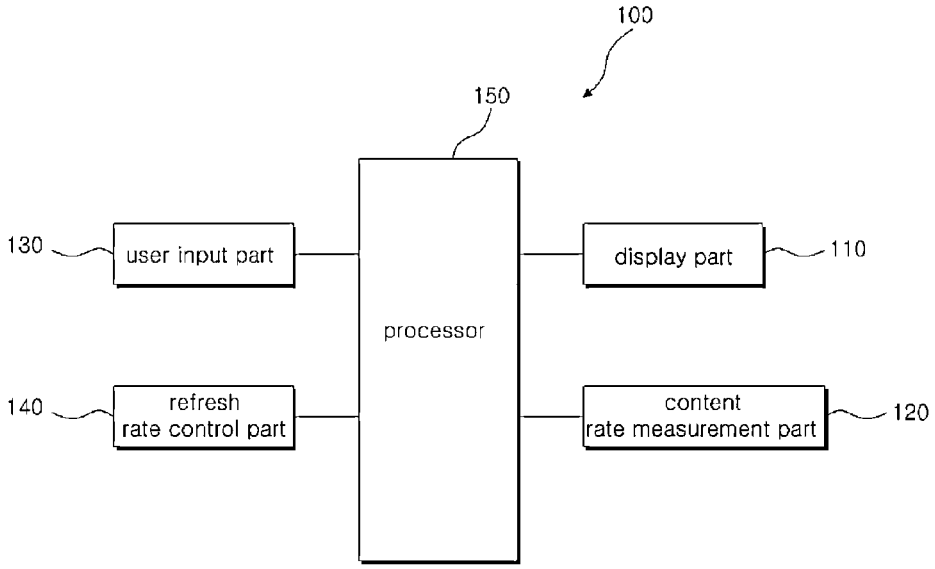
FIG. 2 is a block diagram of an electronic device associated with an embodiment of the invention.

FIG. 2 is a block diagram of an electronic device associated with an embodiment of the invention.

In the present specification, an electronic device is a device capable of displaying a content (e.g. application), such as a mobile terminal for example. The mobile terminal can encompass a smart phone, a laptop computer, a digital broadcasting terminal, a PDA (personal digital assistant), a PMP (portable multimedia player), a navigation unit, a tablet PC, a wearable device, and the like.

As illustrated, the electronic device 100 can include a display part 110, a content rate measurement part 120, a user input part 130, a refresh rate control part 140, and a processor 150.

The display part 110 may show and output the information, data, etc., processed by the electronic device 100. For example, the display part 110 may show a UI (user interface) or GUI (graphic user interface) associated with an application running on the electronic device 100.

In cases where the display part 110 and a touchpad is implemented in a layered structure to form a touch screen, the display part 110 can be used as an input means as well as an output means.

The content rate measurement part 120 can measure the content rate. The method of measuring the content rate will be described later in more detail.

The user input part 130 may allow the user to generate input data for controlling the operation of the electronic device 100. The user input part 130 can be composed of key pad dome switches, a touchpad (constant voltage/constant current), a jog wheel, jog switches, etc. In particular, in cases where the touchpad forms a layered structure with the display part 110 as described above, it can be referred to as a touch screen.

The refresh rate control part 140 can control the refresh rate based on the measured content rate. For example, the refresh rate control part 140 can set the refresh rate high when the measured content rate is high and may adjust the refresh rate to be low when the measured content rate is low.

The processor 150 can generally control the display part 110, content rate measurement part 120, user input part 130, and refresh rate control part 140.

Figure 3:
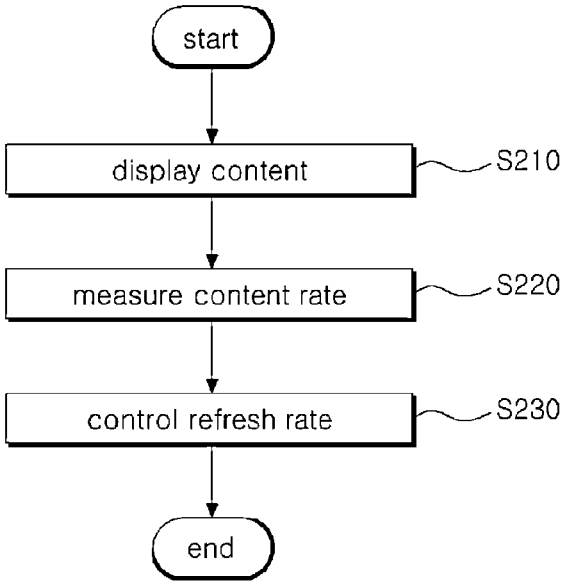
FIG. 3 is a flow diagram illustrating a method for managing power in an electronic device associated with an embodiment of the invention.

FIG. 3 is a flow diagram illustrating a method for managing power in an electronic device associated with an embodiment of the invention.

The display part 110 can display a content (operation S210). For example, the display part 110 can display a particular application that is running.

The content rate measurement part 120 can measure the content rate in certain time intervals (e.g. 1 second intervals) (operation S220).

The content rate measurement part 120 can count meaningful frames by comparing the current frame with the previous frame. In order to accurately compare the current frame and the previous frame with a low cost, a double buffering technique and a grid-based comparison technique can be used. The terms "double buffering" and "grid-based comparison" are names devised herein for convenience.

Figure 4:
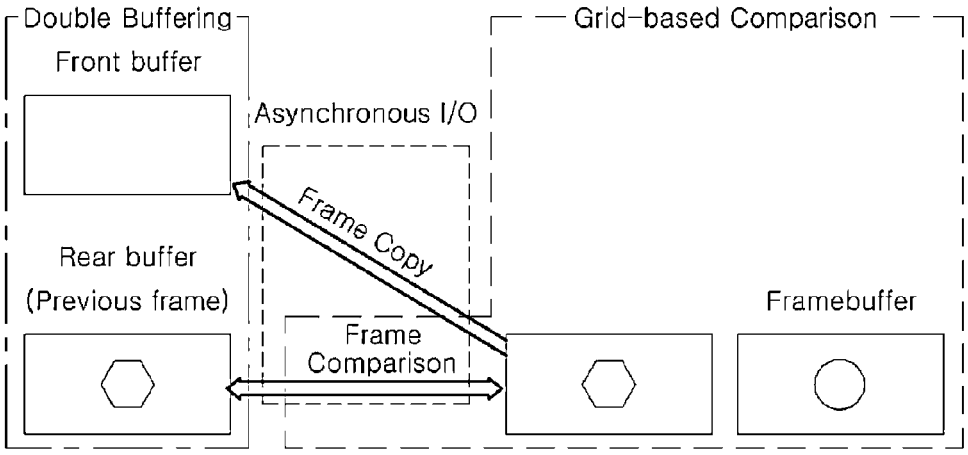
FIG. 4 illustrates an example of measuring the content rate in a method for managing power in an electronic device associated with an embodiment of the invention.

FIG. 4 illustrates an example of comparing the current frame and the previous frame by using double buffering and grid-based comparison in a method for managing power in an electronic device associated with an embodiment of the invention.

The double buffering technique refers to a technique that uses two surplus buffers (front buffer, rear buffer) for comparing the current frame with the previous frame. For example, at time t, the current frame stored in the frame buffer and the previous frame stored in the rear buffer may be compared, and during the comparison between the current frame and the previous frame, the current frame may be copied and stored in the front buffer. Then, at time (t+1), the current frame stored in the frame buffer may be compared with the previous frame stored in the front buffer (the current frame stored at time t), and while the comparison between the current frame and the previous frame is being performed, the current frame may be copied and stored in the rear buffer. That is, one of the front buffer and the rear buffer may be used for storing the previous frame at the current time, and the other may be used for storing the current frame. The roles of the front buffer and the rear buffer can be interchanged in intervals corresponding to the time taken for comparing the current frame and the previous frame. By using the double buffering technique, operation delays can be minimized.

The grid-based comparison technique is a technique for judging whether or not there is a change between a current frame and a previous frame. This technique, instead of comparing all of the pixels of the current frame and the previous frame, compares only the values of a few pixels that correspond to a particular position in the current frame and previous frame in order to reduce the cost of the comparison.

For example, the grid-based comparison can include a method of dividing the current frame and the previous frame into a certain number of blocks and comparing only the representative pixel values (e.g. pixel values corresponding to the center positions) of the divided blocks.

Using the method above, it is possible to judge whether or not a change occurred between the current frame and the previous frame, and the content rate can be measured based on whether or not a change occurred between the current frame and the previous frame.

The refresh rate control part 140 can control the refresh rate based on the measured content rate (operation S230).

The content rate cannot exceed the refresh rate. Therefore, the refresh rate control part 140 may keep the refresh rate higher than the content rate. To this end, at least one of the section-based control technique and the refresh rate boosting technique, which are described below in more detail, can be employed. The terms "section-based control" and "refresh rate boosting" are names devised herein for convenience.

Figure 5:
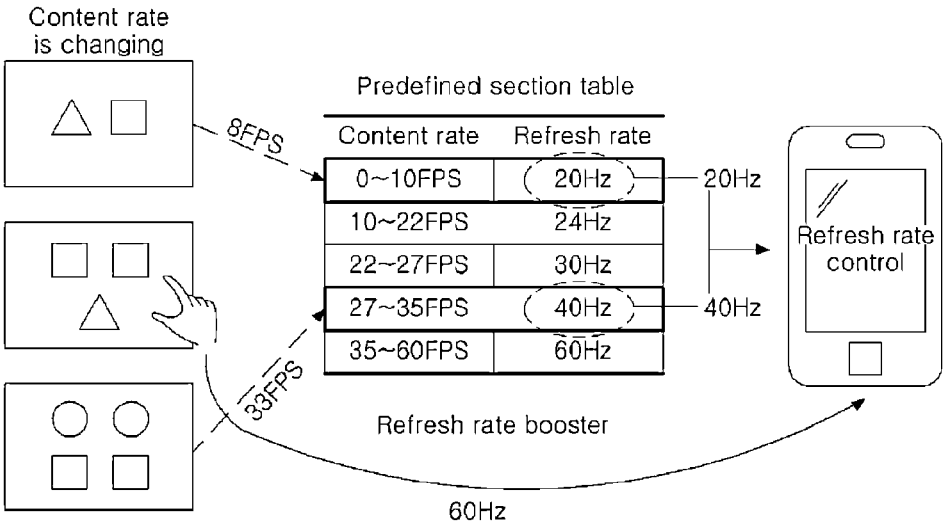
FIG. 5 illustrates an example of controlling the refresh rate in a method for managing power in an electronic device associated with an embodiment of the invention.

FIG. 5 illustrates a method of controlling the content rate by using the section-based control technique and the refresh rate boosting technique in a power management method for an electronic device associated with an embodiment of the invention.

The section-based control technique refers to a technique of dividing the content rate into sections according to the available refresh rates and setting the refresh rates differently for the divided sections. In applying section-based control, a predefined section table can be used. The section table can have the content rate sections divided according to the available refresh rates. Also, the maximum content rate belonging to a particular section can be set lower than the refresh rate corresponding to the particular section. For example, if the refresh rate is 20 Hz, the maximum content rate belonging to the section may be set to 10 FPS, and if the refresh rate is 24 Hz, the maximum content rate belonging to the corresponding section may be set to 22 FPS.

The maximum content rate belonging to the particular section can be determined by Equation 1 shown below.

$$\beta_i = \begin{cases} \frac{\gamma_{i-1} + \gamma_i}{2} & \text{if } i > 1 \\ \frac{\gamma_i}{2} & \text{if } i = 1 \end{cases}, 0 < i < n \quad \text{[Equation 1]}$$

Here, i is the index of an available refresh rate, $\beta_i$ is the maximum content rate mapped to the i-th refresh rate, and $\gamma_i$ is the i-th refresh rate.

If the content rate of the application is suddenly increased due to an interaction by the user, the section-based control cannot adjust the refresh rate suitably to reflect the increased content rate. This is because the content rate cannot exceed the refresh rate.

The refresh rate boosting technique may be used to eliminate delays that may occur with the section-based control. The refresh rate boosting technique refers to a technique of adjusting the refresh rate to a particular set value immediately regardless of the currently measured content rate by a particular user input (e.g. touch input). For example, even when the current content rate is 8 FPS, the refresh rate can be increased immediately to 60 Hz (the maximum available refresh rate) by a particular user input.

Figure 6A:
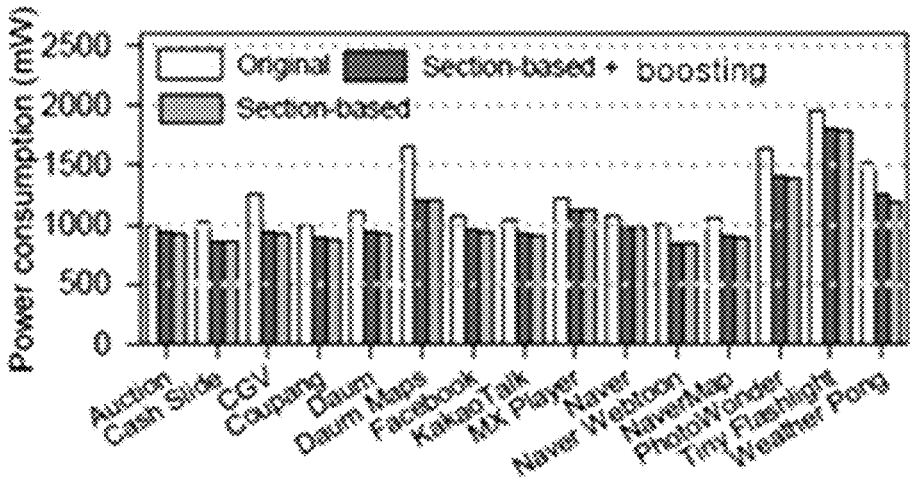
FIG. 6A and FIG. 6B compare the effect of power reduction between a power management method for an electronic device associated with an embodiment of the invention and an existing method.
Figure 6B:
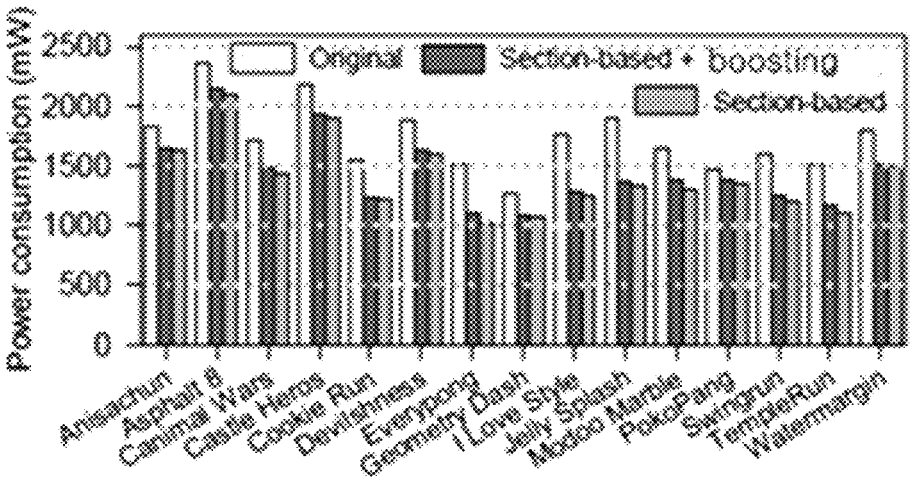

FIG. 6A and FIG. 6B compare the effect of power reduction between a power management method for an electronic device associated with an embodiment of the invention and an existing method.

FIG. 6A shows the power consumption of regular applications, and FIG. 6B shows the power consumption of game applications. In the graphs, "Original" indicates the case of outputting the screen with a fixed refresh rate, "Section-based+boosting" indicates the case in which section-based control and refresh rate boosting are both used, and "Section-based" indicates the case in which refresh rate boosting is not used and only section-based control is used.

From FIG. 6A and FIG. 6B, it can be seen that the power consumption is less for the two cases of "Section-based+boosting" and "Section-based" compared to the case of using a fixed refresh rate. Moreover, it can be seen that "Section-based" leads to lower power consumption than "Section-based+boosting". This is because the refresh rate boosting technique is for immediately adjusting the refresh rate to a particular value (e.g. the maximum available refresh rate).

Figure 7A:
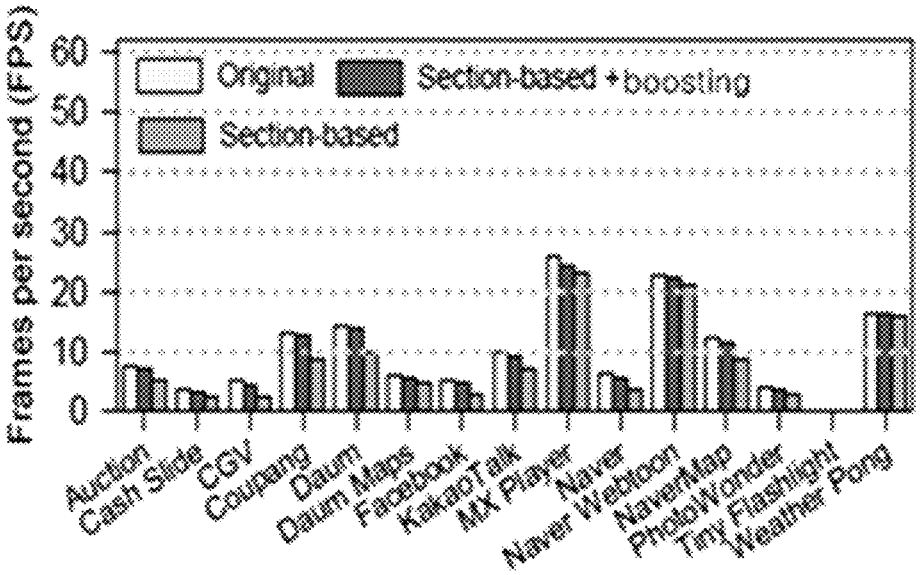
FIG. 7A and FIG. 7B compare picture quality between a power management method for an electronic device associated with an embodiment of the invention and an existing method.
Figure 7B:
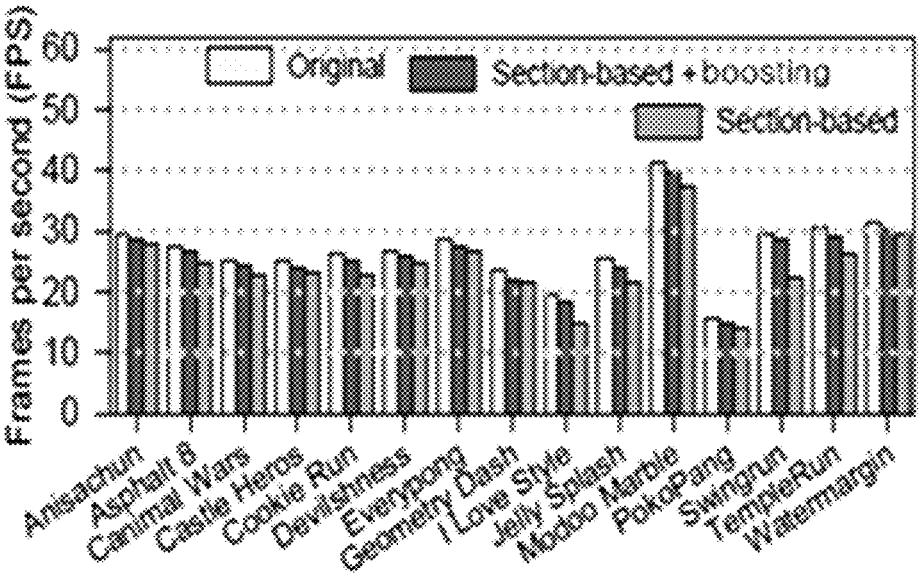

FIG. 7A and FIG. 7B compare picture quality between a power management method for an electronic device associated with an embodiment of the invention and an existing method.

FIG. 7A shows the picture quality of regular applications, and FIG. 7B shows the picture quality of game applications. In the graphs, "Original" indicates the content rate for the case of outputting the screen with a fixed refresh rate, "Section-based+boosting" indicates the content rate for the case in which section-based control and refresh rate boosting are both used, and "Section-based" indicates the content rate for the case in which refresh rate boosting is not used and only section-based control is used.

With the case in which the section-based control technique and the refresh rate boosting technique are both used, the content rate is almost the same as that of the actual application, but with the case in which only the section-based control technique is used, the content rate is measured to be lower than the content rate of the actual application. That is, the case of using both the section-based control and the refresh rate boosting may provide a picture quality that is almost the same as the "Original". However, the case in which only the section-based control technique is used may result in a slightly lower picture quality compared to the "Original".

Figure 8:
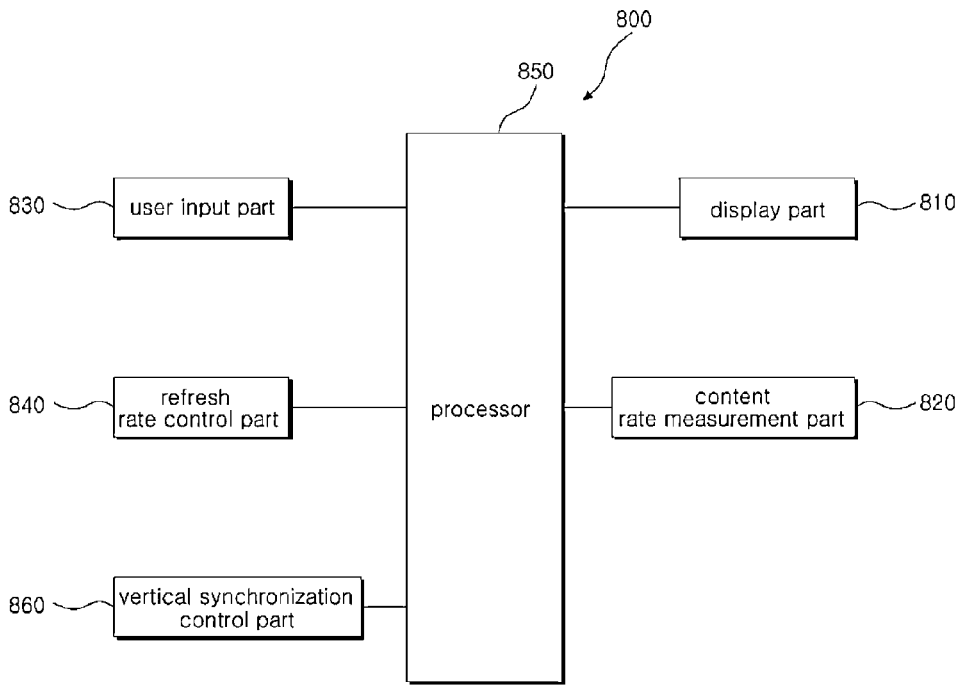
FIG. 8 illustrates an electronic device according to another embodiment of the invention.

FIG. 8 illustrates an electronic device according to another embodiment of the invention.

Referring to FIG. 8, an electronic device 800 according to another embodiment of the invention can include a display part 810, a content rate measurement part 820, a user input part 830, a refresh rate control part 840, a processor 850, and a vertical synchronization control part 860.

In an electronic device according to another embodiment of the invention, the refresh rate control part 840 may control the refresh rate in consideration of preventing the flickering phenomenon.

When the refresh rate is too low, a flickering phenomenon can occur on the display. Such flickering can be avoided by setting the refresh rate higher than a preset value for removing flickering. When the content rate is higher than or equal to the preset value, the refresh rate can be set higher than the content rate.

For example, if the content rate is 10 FPS (frames per second) and the preset value is 20, the refresh rate can be set to 20 Hz, and if the content rate is 30 FPS and the preset value is 20, the refresh rate can be set to a value higher than the content rate. The preset value can be determined empirically according to the type of display, the user, etc.

The electronic device 800 according to another embodiment of the invention can further include a vertical synchronization control part 860, which may control the cycle of the vertical synchronization by using a first refresh rate and a second refresh rate. The vertical synchronization control part 860 can include a signal generation part, which may generate vertical synchronization signals according to the second refresh rate, and a signal control part, which may disable some of the vertical synchronization signals according to the first refresh rate.

Vertical synchronization (V-Sync) is to synchronize the light-emission of the display with the refresh rate. The vertical synchronization signals may be generated according to the refresh rate, and light may be emitted according to the vertical synchronization signals, for example from the backlight of an LCD panel. In an embodiment of the invention, the vertical synchronization signals may be generated according to the second refresh rate, but some of the vertical synchronization signals may be disabled according to the first refresh rate. An alternative design can have some of the vertical synchronization signals enabled according to the first refresh rate. In this way, the cycle of vertical synchronization can be adjusted.

For example, consider a case in which the content rate is 20 FPS and the threshold value for preventing flickering is 40. According to an embodiment of the invention, the first refresh rate can be determined as 30 Hz, and the second refresh rate can be set to 40 Hz. In this case, the vertical synchronization signals may be generated according to the second refresh rate of 40 Hz, and an embodiment of the invention may disable ten of the vertical synchronization signals according to the first refresh rate.

The resulting effect is an operation similar to having the vertical synchronization set at 30 Hz. As the cycle of the vertical synchronization is lengthened, the display may blink at a smaller frequency, so that the flickering phenomenon can be reduced as well as the amount of power consumption.

Depending on the design, the vertical synchronization signals can be generated according to only the first refresh rate. In this case, the cycle of the vertical synchronization can be controlled according to the first refresh rate irrespective of the second refresh rate. Also, if the first refresh rate is higher than the threshold value, there would be no second refresh rate set separately, and the cycle of the vertical synchronization may be controlled according to the first refresh rate.

Figure 9:
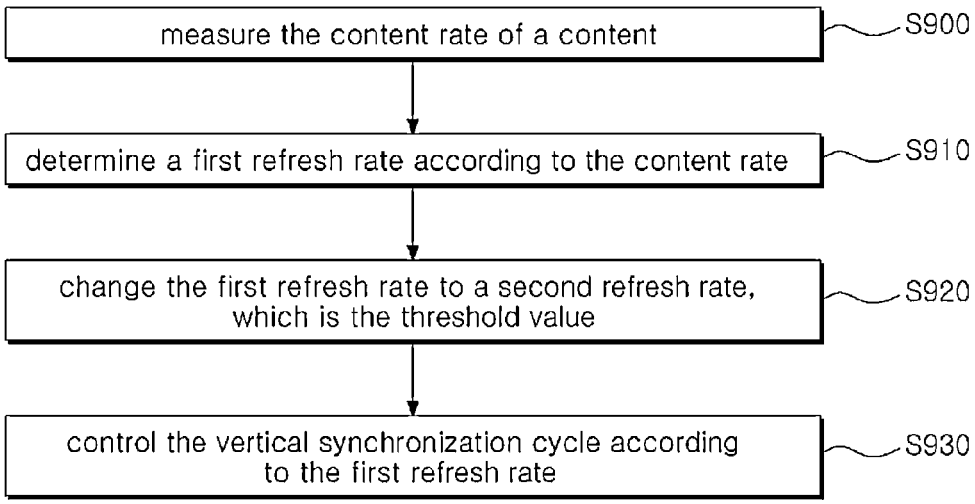
FIG. 9 is a flowchart illustrating a method for managing power in the electronic device shown in FIG. 8.

FIG. 9 is a flowchart illustrating a method for managing power in the electronic device shown in FIG. 8.

Referring to FIG. 9, the electronic device 800 may measure the content rate of a content according to whether or not there is a frame change in the content (operation S900).

Then, the electronic device 800 may determine the first refresh rate according to the content rate (operation S910), and if the first refresh rate is smaller than the threshold value, may change the first refresh rate to a second refresh rate that is greater than or equal to the threshold value (operation S920). Here, the threshold value may be a value set for reducing or eliminating the flickering phenomenon and can be determined empirically according to the type of display, the user, etc.

An embodiment of the invention can control the refresh rate to be greater than or equal to the threshold value for removing flickering and can thus provide the user with a comfortable image.

A power management method according to an embodiment of the invention can further include an operation of controlling the cycle of the vertical synchronization by using the first refresh rate and the second refresh rate (operation S930). In cases where the content rate varies within a particular section that is lower than a threshold value, the second refresh rate may be set to the threshold value, and the first refresh rate may vary in subordination to the content rate. In this case, it can be said that the cycle of the vertical synchronization is determined according to the content rate. Also, as described above, the cycle of the vertical synchronization can be controlled according to the first refresh rate.

Although it is not illustrated in the drawings, the operation of controlling the cycle of the vertical synchronization can include: generating vertical synchronization signals according to the second refresh rate and disabling some of the vertical synchronization signals according to the first refresh rate.

According to an embodiment of the invention illustrated in FIG. 8 and FIG. 9, a threshold value can be set for preventing flickering, and the cycle of the vertical synchronization can be controlled by using a refresh rate that is smaller than or equal to the threshold value, so that the user can be provided with a comfortable image while the effect of power reduction can be maximized.

Figure 10:
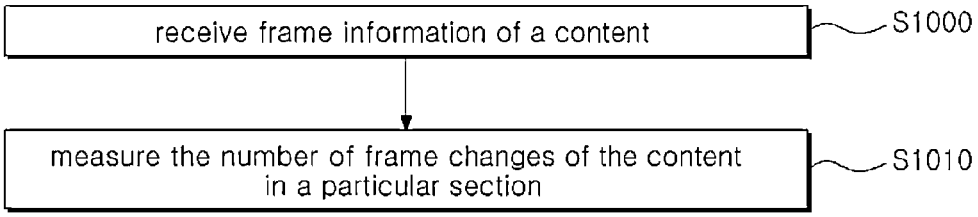
FIG. 10 and FIG. 11A and FIG. 11B illustrate a method for managing power in an electronic device according to an embodiment of the invention.
Figure 11A:
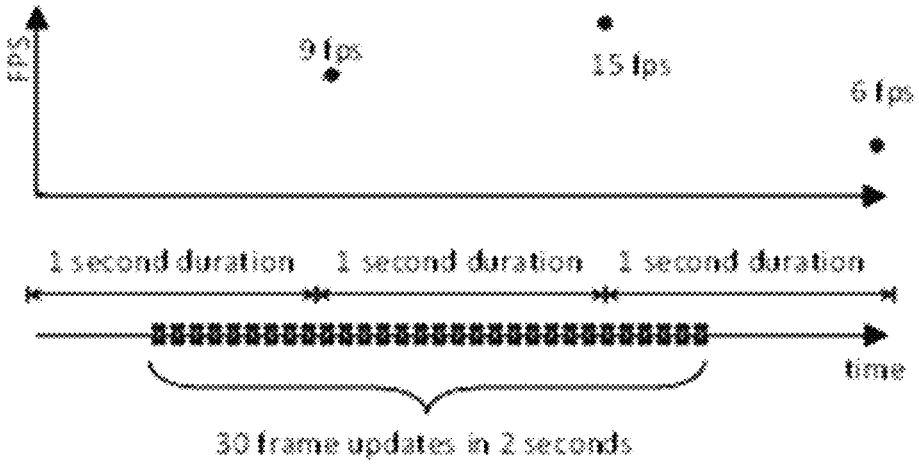
Figure 11B:
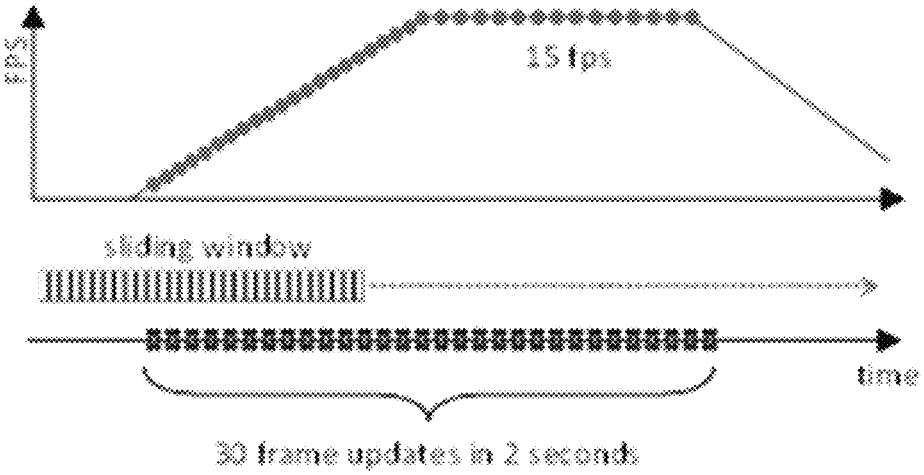

FIG. 10 and FIG. 11A and FIG. 11B illustrate a method for managing power in an electronic device according to an embodiment of the invention.

The content rate can be measured per unit time, for example, and the method of measuring the content rate per unit time falls within the scope of the present invention. FIG. 10 and FIG. 11A and FIG. 11B illustrate a method of measuring the content rate more efficiently.

An electronic device according to an embodiment of the invention may receive, i.e. as input, the frame information of a content (operation S1000). Then, the electronic device may measure the number of frame changes of the content in a particular section (sliding window) (operation S1010). Here, the particular section may be the section of the most recent 1 second with respect the point at which a frame change occurs in the content, that is, the section from a unit amount of time prior to the point of frame change of the content up to the point at which the frame change occurs in the content. For example, the unit time can be 1 second.

FIG. 11A illustrates a method of measuring the number of changes in the frames per unit time. FIG. 11B illustrates a method of measuring the number of changes in the frames with respect to a point of frame change. In FIG. 11A and FIG. 11B, the unit time is 1 second, and the X marks on the timeline represent points at which a change occurred in the frame. Also, in FIG. 11A and FIG. 11B, the vertical axis represents the content rate.

In FIG. 11A, the content rate may be measured per unit time and thus may be measured in cycles of 1 second. Therefore, as illustrated in FIG. 11A, the content rate may be reset in units of 1 second. In FIG. 11B, however, as the content rate may be determined with respect to the points at which frame changes occur, the content rate can be reset every time a change in the frame occurs.

Consequently, in the same environment, the case of measuring the content rate as in FIG. 11B can result in the content rate being reset more rapidly, and as the content rate is reset rapidly, the number of frames projected on the screen can be rapidly reduced, for a reduction in power consumption.

The method for managing power in an electronic device described above can be implemented in the form of program instructions that may be performed using various computer means and can be recorded in a computer-readable medium. Such a computer-readable medium can include program instructions, data files, data structures, etc., alone or in combination. The program instructions recorded on the medium can be designed and configured specifically for the present invention or can be a type of medium known to and used by the skilled person in the field of computer software.

Examples of a computer-readable medium may include magnetic media such as hard disks, floppy disks, magnetic tapes, etc., optical media such as CD-ROM's, DVD's, etc., magneto-optical media such as floptical disks, etc., and hardware devices such as ROM, RAM, flash memory, etc.

The recorded medium can also be a transmission medium, such as optical rays, metal wires, waveguides, etc., that transports carrier waves for transmitting signals which designate the program instructions, data structures, etc.

Examples of the program of instructions may include not only machine language codes produced by a compiler but also high-level language codes that can be executed by a computer through the use of an interpreter, etc. The hardware mentioned above can be made to operate as one or more software modules that perform the actions of the embodiments of the invention, and vice versa.

The method for managing power in an electronic device and the electronic device as described above are not to be limited to the embodiments described herein. Numerous variations of the embodiments are possible, which can be implemented by selectively combining some or all features of different embodiments.

What is claimed is:

1. A method for managing power in an electronic device, the method comprising:

measuring a content rate of a displayed content;

controlling a refresh rate based on the content rate;

wherein the content rate is determined by a comparison between a number of pixel values corresponding to a particular position in a previous frame and in a current frame;

wherein the controlling of the refresh rate comprises:

determining the refresh rate by using a section table having content rate sections divided according to available refresh rates and wherein a maximum content rate belonging to the content rate section is lower than a refresh rate mapped to the section; and wherein the maximum content rate belonging to the section is determined by Equation 1 shown below:

$$\beta_i = \begin{cases} \frac{\gamma_{i-1} + \gamma_i}{2} & \text{if } i > 1 \\ \frac{\gamma_i}{2} & \text{if } i = 1 \end{cases}, 0 < i < n \quad \text{[Equation 1]}$$

where i is an index of an available refresh rate, $\beta_i$ is a maximum content rate mapped to an i-th refresh rate, and $\gamma_i$ is the i-th refresh rate.

2. The method of claim 1, further comprising:

receiving a particular user input; and changing the refresh rate to a set value based on the particular user input.

3. An electronic device comprising:

a display part configured to display a content;

a content rate measurement part configured to measure a content rate of the displayed content;

a refresh rate control part configured to control a refresh rate based on the content rate;

a processor configured to control the display part, the content rate measurement part, and the refresh rate control part;

wherein the content rate is determined by a comparison between a number of pixel values corresponding to a particular position in a previous frame and in a current frame;

wherein the refresh control part determines the refresh rate by using a section table having content rate sections divided according to available refresh rates, wherein a maximum content rate belonging to the content rate section is lower than a refresh rate mapped to the section, and wherein the maximum content rate belonging to the section is determined by Equation 1 shown below:

$$\beta_i = \begin{cases} \frac{\gamma_{i-1} + \gamma_i}{2} & \text{if } i > 1 \\ \frac{\gamma_i}{2} & \text{if } i = 1 \end{cases}, 0 < i < n \quad \text{[Equation 1]}$$

where i is an index of an available refresh rate, $\beta_i$ is a maximum content rate mapped to an i-th refresh rate, and $\gamma_i$ is the i-th refresh rate.

* * * * *